United States Patent [19]

Browning

[11] Patent Number: 4,621,404

[45] Date of Patent: Nov. 11, 1986

[54] PROCESS FOR MAKING MOLDED WHEELED LUGGAGE

[76] Inventor: Arthur J. Browning, P.O. Box 4508, Toms River, N.J. 08754-4508

[21] Appl. No.: 764,635

[22] Filed: Aug. 12, 1985

Related U.S. Application Data

[62] Division of Ser. No. 594,122, Mar. 28, 1984, Pat. No. 4,550,813.

[51] Int. Cl.[4] ..... B21D 39/02; A45C 13/26

[52] U.S. Cl. ..... 29/463; 190/18 A; 190/8; 190/102; 190/115; 190/127; 220/72; 280/37; 280/47.26

[58] Field of Search ..... 29/434, 463; 190/8, 190/18 A, 102, 127, 115; 220/66, 72, 70; 206/349, 379, 380, 545; 224/158, 159; 280/37, 42.26, 47.37, 655; 264/241, 250

[56] References Cited

U.S. PATENT DOCUMENTS

| | | |
|---|---|---|
| 1,490,066 | 4/1924 | Carr . |
| 2,510,643 | 6/1950 | Long . |
| 2,537,864 | 1/1951 | Skaer . |
| 2,687,157 | 8/1954 | Cowan . |
| 2,822,800 | 2/1958 | Kivett . |
| 2,832,488 | 4/1958 | Axtell . |
| 2,844,244 | 7/1958 | Hanson . |
| 2,920,802 | 1/1960 | Cook . |
| 3,010,552 | 11/1961 | Davidson . |
| 3,025,947 | 3/1962 | Hammer . |
| 3,112,018 | 11/1963 | Gehrie . |
| 3,135,366 | 6/1964 | Holtzman . |
| 3,136,398 | 6/1964 | Platt . |
| 3,154,192 | 10/1964 | Cowley . |
| 3,257,051 | 6/1966 | Browning . |
| 3,257,120 | 6/1966 | Browning . |
| 3,292,252 | 12/1966 | Reading . |
| 3,298,479 | 1/1967 | Palmer et al. . |
| 3,306,402 | 2/1967 | Heitler et al. . |
| 3,313,382 | 4/1967 | Rosing et al. . |
| 3,327,841 | 6/1967 | Schurman et al. . |
| 3,339,781 | 9/1967 | Schurman et al. . |
| 3,987,829 | 10/1976 | Leone . |
| 4,036,336 | 7/1977 | Burtley . |
| 4,066,156 | 1/1978 | Basile . |
| 4,314,624 | 2/1982 | Royet . |

FOREIGN PATENT DOCUMENTS

| | | |
|---|---|---|
| 139726 | 3/1949 | Australia . |
| 71110 | 6/1950 | Denmark . |
| 585378 | 2/1947 | United Kingdom . |
| 986028 | 3/1965 | United Kingdom . |

*Primary Examiner*—Howard N. Goldberg
*Assistant Examiner*—Timothy V. Eley
*Attorney, Agent, or Firm*—Morgan & Finnegan

[57] ABSTRACT

There is disclosed a strong, light-weight, rigid molded, plastic luggage provided with wheels and a retractable handle. The luggage ensemble utilizes the shape of respective individual pieces of the luggage and retention means to hold them in assembled relationship and utilization of the retractable handle and the wheels facilitate transportation of the relatively large load formed by the ensemble by an individual. The process for making the luggage, due to the unique structural design of its elements and the materials from which they are made, comprises unique, yet simple, molding and manufacturing steps which allow for facile assembly of a wide variety of luggage parts to form the completed product.

4 Claims, 16 Drawing Figures

PROCESS FOR MAKING MOLDED WHEELED LUGGAGE

This is a division of application Ser. No. 594,122 filed Mar. 28, 1984 now U.S. Pat. No. 4,550,813.

BACKGROUND OF THE INVENTION

This invention relates to luggage, an ensemble thereof, and a process for making the same. More particularly, the invention is directed to strong, light-weight, rigid, molded, plastic luggage which may be mobile in nature, may be an ensemble thereof, and a process for manufacturing the same.

A wide variety of luggage made of a wide variety of materials and specific designs and which exhibits many different particular advantages is known and readily available to the buying public through normal commercial channels. For many years in the past through to the present time much research and developmental effort has been expended in the area of luggage technology to provide luggage having various advantageous benefits to the public. For example, U.S. Pat. Nos. 3,010,552; 3,112,018; 3,292,252; 3,391,765 and 3,513,951 are illustrative of a number of patents which disclose primarily examples of valances and frame structures employed in luggage and which are metallic in nature. On the other hand, examples of known mobile, wheeled luggage which may be hooked together, that is utilized in the form of ensembles, are disclosed in U.S. Pat. Nos. 3,805,929 and 4,036,336.

Still further, examples of luggage in which a plastic body is employed are typified by U.S. Pat. Nos. 2,822,900 and 3,135,366, the latter employing a metal valance with a plastic body. As further examples of the development and design of luggage are U.S. Pat. Nos. 3,306,402 which is illustrative of one of a number of designs of integral feet for supporting the luggage when it is to be rested or deposed in an upright position, and 2,832,448 which is illustrative of a tongue and groove structure which permits the upper and lower sections of a hinged luggage to be brought into close mating relationship when the luggage is closed.

Another example of a wheeled luggage is disclosed in U.S. Pat. No. 3,948,365 which disclosed a molded luggage having wheel wells molded in the side panels of the luggage containing members and, as well, integrally molded support feet.

On the other hand, U.S. Pat. No. 3,799,568 discloses one particular design of a luggage handle disposed in the outer periphery of the luggage container and set in a depressed or raised area of the container per se.

In order to provide required rigidity and strength to luggage, whether it be made of a plastic material or some other material, developments led to the provision of ridges or ribs or corrugations in the walls of the luggage body members per se. Examples of such supporting means are disclosed in U.S. Pat. Nos. 3,313,382 and 3,136,398.

With the advent of the development of plastic molded luggage bodies, developments led not only to integrally molded feet but also to integrally molded hinge means such as illustraded in U.S. Pat. Nos. 3,339,781, 3,025,947 and 2,687,157. Still further examples of molded plastic luggage or cases are U.S. Pat. Nos. 3,565,305; 2,920,802 and 2,510,643.

In addition to the above mentioned developments as disclosed in the particular patents mentioned, the inventor of the novel, unique luggage of the instant case has also contributed to luggage developments of one kind or another as illustrated in U.S. Pat. No. 3,606,372 for wheeled luggage, and U.S. Pat. Nos. 3,257,120 and 3,257,051, which relate, respectively, to a handle assembly for attachment to a conventional piece of luggage and to a luggage sling which may be employed to attach luggage such as illustrated, for example, in U.S. Pat. No. 3,606,372 in an ensemble.

While the prior art developments and designs, such as those described above, as well as other developments and designs of luggage, have in the main been commercially accepted by the general public, most of the designs developed still evidence various drawbacks or disadvantages of one type or another. For example, among such disadvantages are the wheel wells and wheel assemblies in known luggage which are often not truly waterproof in nature. In various luggage structures which employ shaped, plastic bodies, the required strength or rigidity which must be imparted thereto is generally achieved by the use of metal ribs, and the mating between the two havles of such a luggage is made more accurate by the utilization of metal valances. Moreover, in accordance with many of the known designs where wheeled luggage are provided with feet, whether such feet be integrally molded or not, the wheels and feet are disposed in such a manner that one cannot open the upper part of the luggage to a clear 180° limit. Thus, as a practical matter, such constructions present problems in attempting to pack the same. In addition to those mentioned disadvantages, currently known luggage often exhibits other disadvantages, such as not being suitably shaped to dispose in an ensemble when one or more second pieces are to be utilized. Further, the disposition of the handles, hasps, locks and also a retractable handle, when one is employed for transporting the luggage with ease, are all disposed in a manner such that they detract not only from the aesthetic aspects thereof, but also from the viewpoint of functionality.

There exists, therefore, a need for a luggage which does not exhibit the above-mentioned disadvantages among others. The present invention fulfills this need.

BRIEF STATEMENT OF THE INVENTION

In accordance with the present invention there is provided a light-weight, strong, molded, rigid, plastic luggage comprising in combination a first molded, one-piece plastic section and a second molded, one-piece plastic section adapted to cooperate with each other, each of the sections including a side panel, four integrally molded, sloping walls having sloping curved corners and angled edges projecting upwardly from and enclosing the side panel; integrally molded support means disposed on the side panel of at least one of the sections extending up the walls towards the angled edges substantially midway between the ends of the walls; each of the sections further being provided with integrally molded butt hinge means and a reinforcing rib disposed on the periphery of one of the walls and a plurality of shaped recesses for receiving the cooperating halves of locks or catches disposed on the wall directly opposite; the wall provided with the butt hinge means of at least one of the sections also being provided with at least two integrally molded feet located in the vicinity of the ends of and opposite the butt hinge means; three of the walls of the second section being provided with a pair of peripheral parallel ribs forming an offset groove extending continuously around and near the periphery thereof, and three of the walls of the first section being provided with an offset tongue including a supporting rib which extends continuously around and near the periphery thereof; the butt hinge means on the first and second sections being positioned thereon so that they interleave with each other and form a continuous passageway for reception of a hinge pin, the offset tongue and said offset groove being positioned on the respective sections so that they mate and the shaped recesses being positioned on the respective sections so that they are located across from each other when the sections are assembled in cooperative relationship.

THE DRAWINGS

In order to understand the present invention more readily, reference is directed to the attached drawings which are to be taken in conjunction with the following description.

In the drawings:

FIG. 1 is a plan view of a luggage open to 180° in accordance with the invention and showing the support means disposed on the internal surface of the molded plastic sections;

FIG. 2 is a plan view of another embodiment of a luggage according to the invention opened to 180° showing support means disposed partially on the internal surface of one section, as well as illustrating the internal disposition of the retractable handle in the shallow channel formed by the ribs extending across the internal surface of the one side panel and the integrally molded upwardly extending wheel wells and feet recesses of one section;

Figure 14:
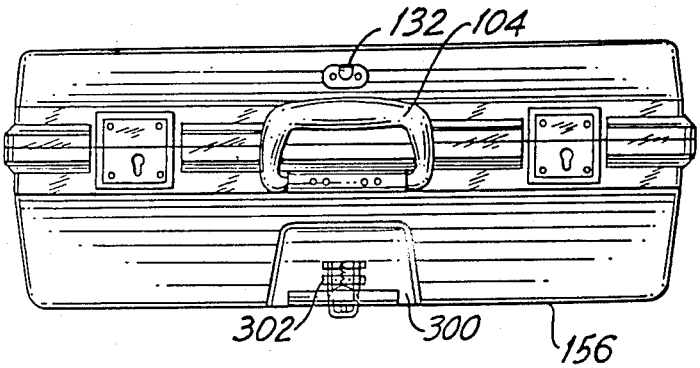
FIG. 14 is a plan view of another embodiment of a luggage in accordance with this invention in closed position showing the lock and the extensible handle disposed in a molded water proof groove molded in the side panel of one section thereof.
Figure 16:
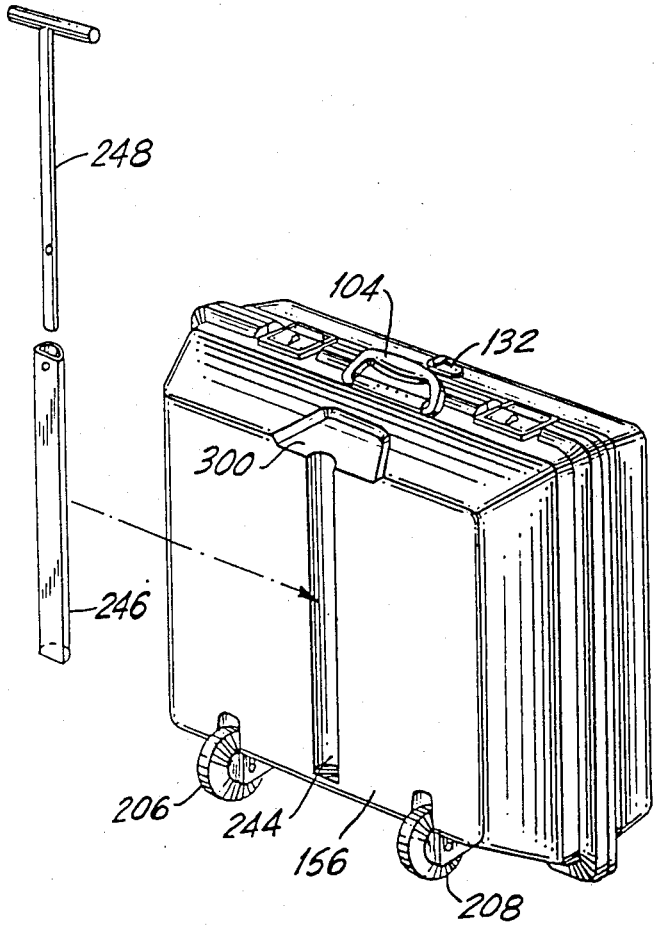
Figure 15:
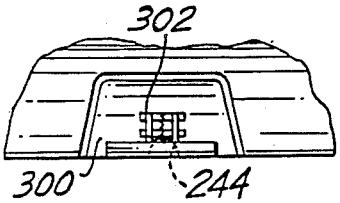

FIG. 15 is a partial sectional view of the luggage illustrated in FIG. 14 with part of the lock removed and showing the outline of the molded water proof groove in a broken line; and FIG. 16 is a lateral view in perspective of the luggage illustrated in FIG. 14 with the lock removed showing the molded water proof groove molded in the side panel of one section and the extensible handle and housing tube therefor separated from the groove.

DESCRIPTION OF THE PREFERRED EMBODIMENTS

Figure 1:
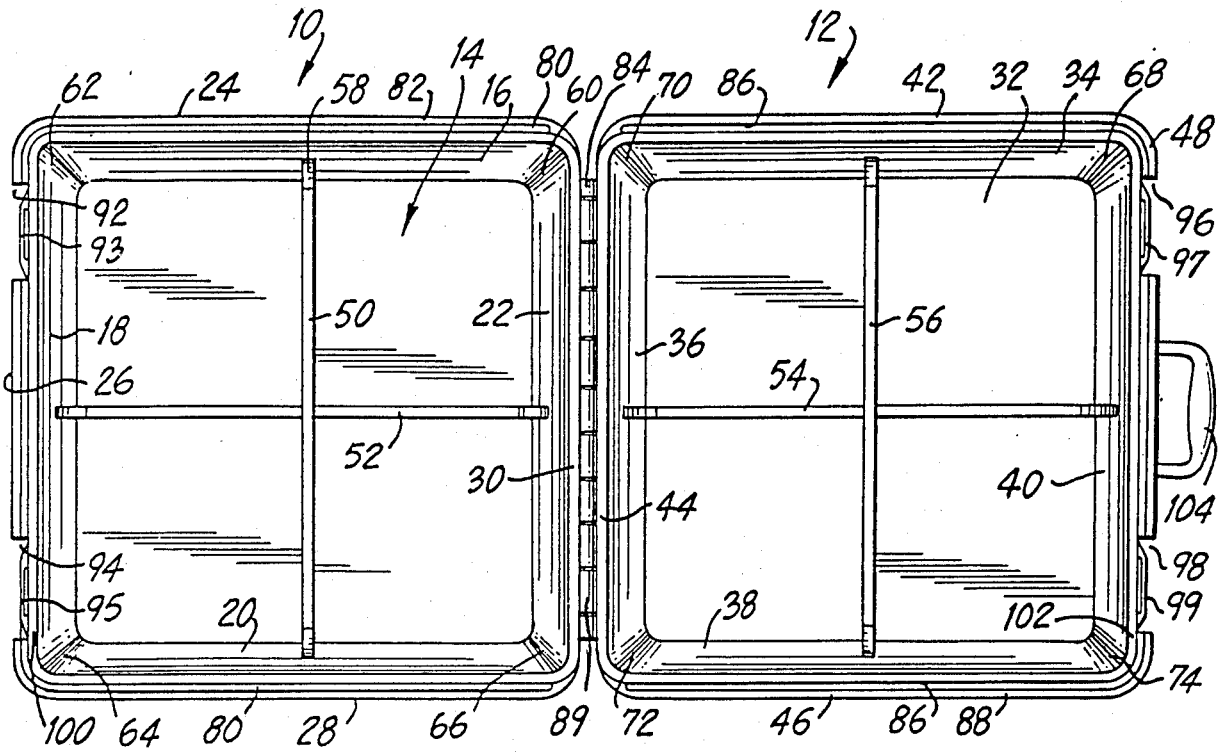

Referring now more particularly to FIG. 1, a lightweight, strong, molded, rigid plastic luggage in accordance with one embodiment of this invention comprises a first molded one-piece plastic section generally referred to by numeral 10, and a second molded one-piece plastic section generally referred to by numeral 12. Section 10 includes a thin side panel 14 provided with outwardly sloping walls 16, 18, 20 and 22 which have angled edges 24, 26, 28 and 30. Section 12, like section 10, is also provided with a thin side panel 32 and sloping walls 34, 36, 38 and 40 having angled edges 42, 44, 46 and 48. In order to provide additional strength and rigidity to sections 10 and 12, they are provided, respectively, with sloping, shallow crossed rib braces 50, 52, 54 and 56, which extend partially up the sides of each section and towards the edges thereof as indicated more particularly by numeral 58.

Figure 6:
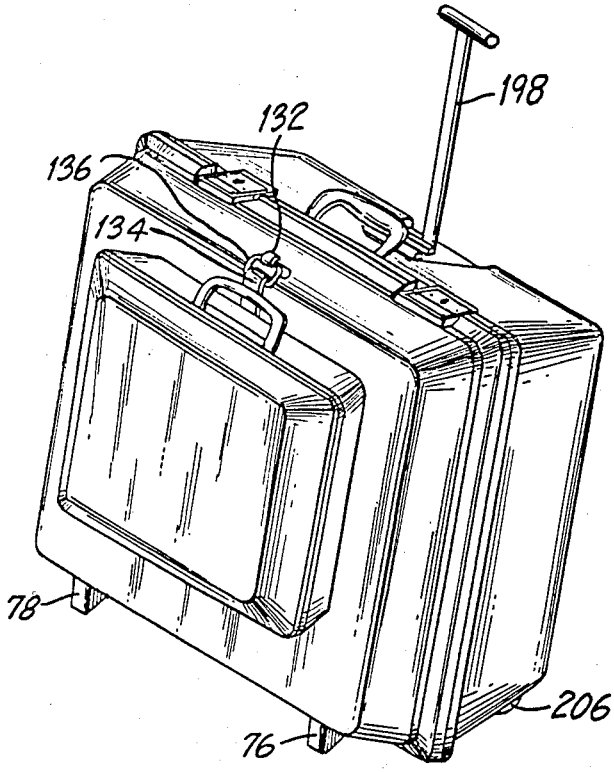
FIG. 6 is a view in perspective of a luggage in accordance with the invention showing the extensible handle in extended form and a second luggage disposed in assembly therewith.

In accordance with this invention, it is to be noted that the sloping walls of each section are shaped so that they form sloping curved corners 60, 62, 64, 66, 68, 70, 72 and 74. Section 10, which forms the lid section of the luggage, may optionally be provided with a pair of integrally molded feet 76 and 78 as may be seen more particularly in FIGS. 4, 6 and 8.

Figure 4:
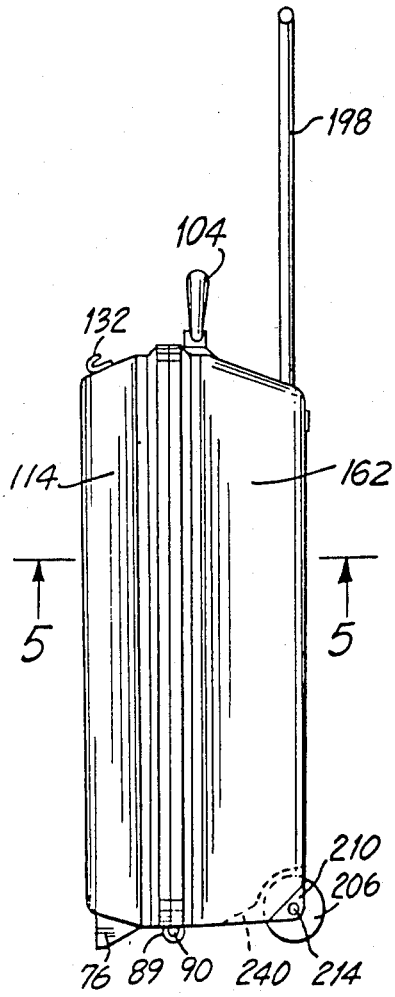
FIG. 4 is a lateral view of the luggage shown in FIG. 3 in closed position with the extensible handle extended and the luggage resting on the integrally molded feet and the wheel elements.
Figure 5:
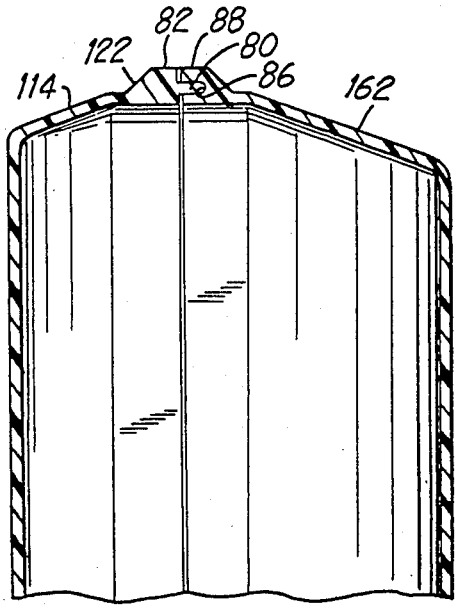
FIG. 5 is a partial sectional view of the luggage illustrated in FIG. 4, taken through lines 5—5 of FIG. 4 with the extensible handle, handgrip and hook omitted and illustrating the tongue and groove relationship of the molded plastic sections as well as the sloping walls and angled edges of such sections.

As shown in greater detail in FIGS. 1 and 5, the sloping walls of section 10 are provided with an offset tongue 80 supported by a rib 82 on three sides and on the fourth side with one-half of a butt hinge means 84. In order to properly mate with section 10, section 12 of the luggage, on the other hand, is provided with an offset groove 86 and a supporting rib 88 which extend around three of the peripheral edges of the sloping walls of section 12. The remaining fourth side of section 12 is provided, like section 10, with one-half of a butt hinge means 89, so that when the sections are mated the butt hinge means of one section will be interleaved with the butt hinge means of the other section and thus form a continuous hinge structure which is fitted with a suitable hinge pin 90, as shown more particularly in FIG. 4.

Both sections 10 and 12 are provided with a plurality of recesses 92, 94, 96 and 98 which are located in such a fashion that they will be directly opposite each other when the sections are mated. Recesses 92 and 94 have disposed therein the top halves of suitable hasps, locks or catchs, 93 and 95, which mate with the bottom halves of suitable hasps, locks or catches, 97 and 99, which are disposed in recesses 96 and 98 of section 12, thus providing means to lock the luggage when the sections are mated.

In addition to the above described structure, both sections 10 and 12 are provided with thickened portions 100 and 102 to impart further rigidity to the luggage, portion 102 of section 12 having affixed thereto a suitable means for carrying such a handle or grip 104.

The described sections 10 and 12 exclusive of the hasps, locks or catches, the carrying handle and the hinge pin can be made simply and easily by any plastic molding process, such as, for example, injection molding, and constructed of a suitable plastic material such as polyurethane, nylon, polyethylene, polyvinylchloride and the like, and which may be either foamed or unfoamed.

Consequently, sections 10 and 12 may be made without the necessity of separate manufacturing of strengthening metal valances, as well as metal hinge structures, which are normally employed in luggage and require separate manufacturing steps and thus additional costs both with respect to labor and materials. Moreover, once sections 10 and 12 have been molded to form the particularly described structures set forth above, the sections may be placed in a jig, and all of the necessary openings punched or drilled therein simultaneously so that the hardware portions of the luggage can be appropriately attached by riveting or other suitable means.

Figure 9:
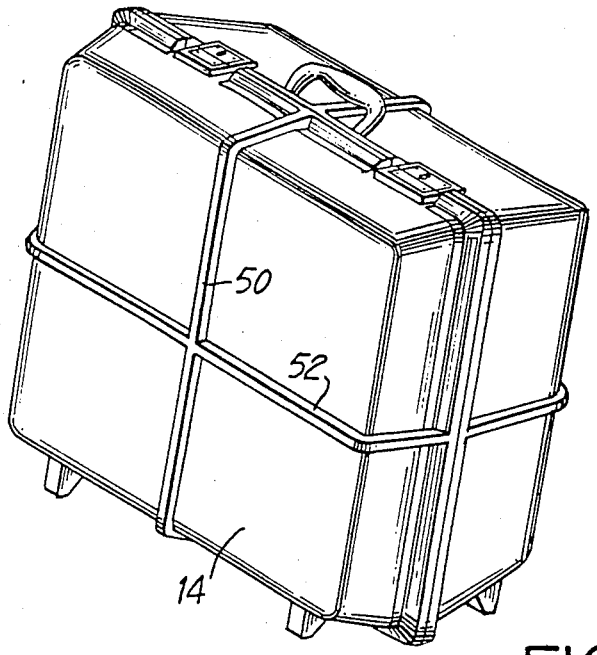
FIG. 9 is a view in perspective of another embodiment of a luggage in accordance with this invention showing support means disposed on the external surface of the molded, one-piece plastic sections.
Figure 10:
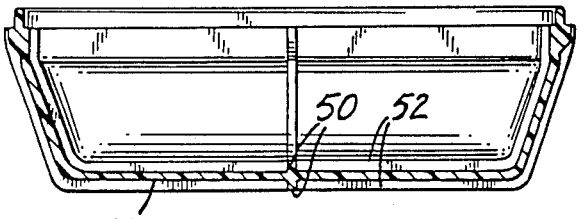
FIG. 10 is a partial sectional view of another embodiment of a luggage in accordance with this invention showing support means disposed partially on the interior surface and partially on the external surface of the molded, one-piece plastic sections.

In accordance with variations of the above-described sections, the supporting ribs may be disposed on the exterior surfaces of each section or molded partially outside of and partially inside of each section, if desired, as shown in greater detail in FIGS. 9 and 10. In accordance with this invention the particular structural configuration of each section as described provides sections which, when mated, form a strong, lightweight, rigid, plastic luggage which is essentially watertight in construction.

Figure 2:
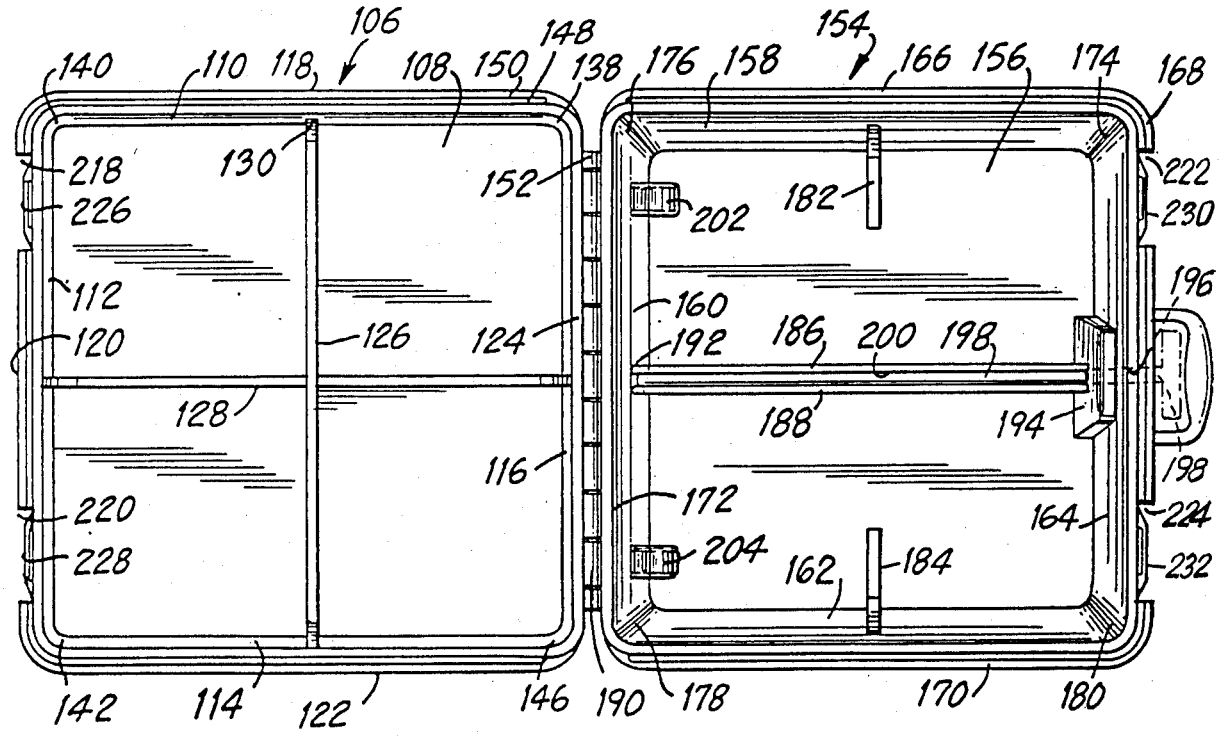

Referring now more particularly to FIG. 2, a preferred embodiment of a luggage in accordance with this invention comprises a first molded one-piece plastic section generally referred to by numeral 106. Sectional 106 is the same construction as section 10 shown in FIGS. 1 and 5 and includes a thin side panel 108 provided with outwardly sloping walls 110, 112, 114 and 116 which have angled edges 118, 120, 122 and 124. Section 106 is further provided with sloping shallow cross rib braces 126 and 128 which extend partially up the sides of section 106 and toward the edges thereof as indicated mroe particularly by numberal 130. On the other hand, as may be seen more specifically from FIGS. 3, 4, 6 and 7, section 106 is provided on wall 112 with an attaching means such as hook 132 so that additional luggage either constructed along the lines of that shown in FIG. 1 or conventional lightweight luggage modified with a suitable lead 134 and "D"-ring attachment 136 can be attached to the lid portion of the luggage of this embodiment. Alternatively, a device for carrying an infant, that is a baby carrying device 137 or 139, as shown in FIGS. 11 and 12 could be attached to the lid portion using lead 134 and attachment 136.

Figure 11:
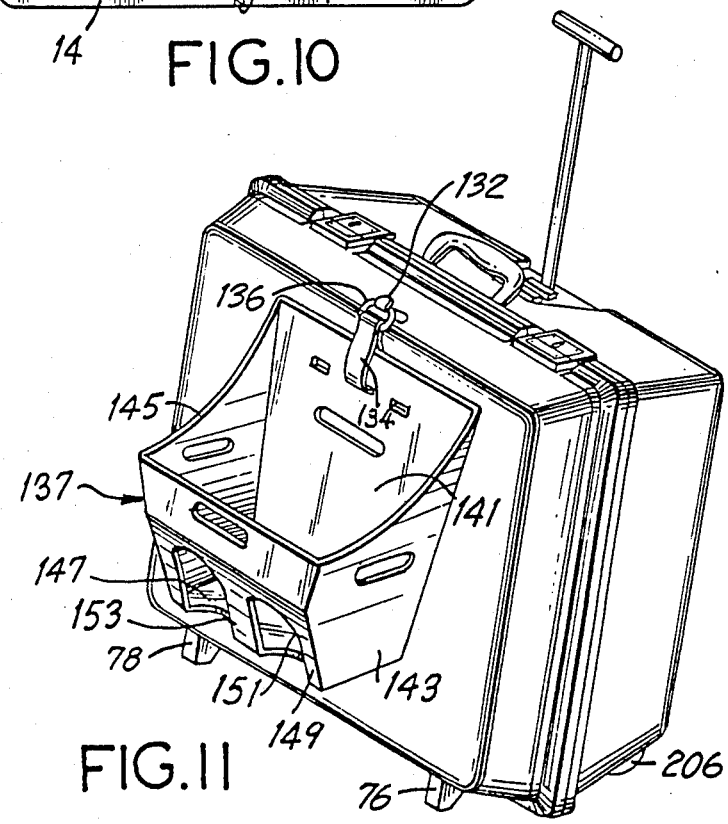
FIG. 11 is a view in perspective of a luggage in accordance with the invention showing a rigid baby carrier disposed in assembly therewith.
Figure 12:
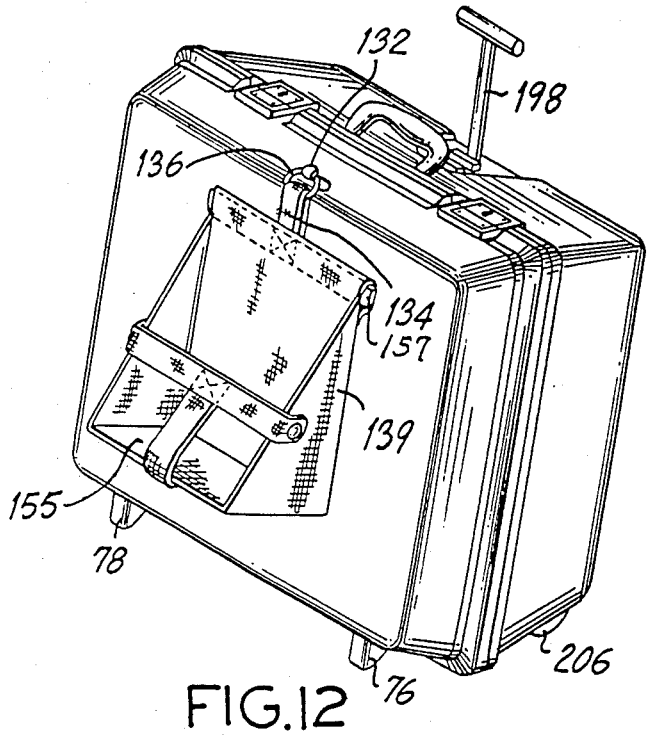
FIG. 12 is a view in perspective of a luggage in accordance with the invention showing a foldable baby carrier disposed in assembly therewith.

The baby carrying device 137 may be rigid as shown in FIG. 11 or flexible and foldable as shown at 139 in FIG. 12. In this connection, a suitable rigid baby carrying device 137 may be made of a wide variety of plastic materials, such as polyurethane, nylon, polyethylene, polyvinylchloride and the like and generally comprises a back panel 141, preferably sloping side panels 143 and 145, a bottom panel 147 and a preferably sloping front panel 149 provided with openings 151 and 153 through which an infant's legs are passed when in use. Back panel 141 generally has the above-described lead 134 and "D"-ring 136 attached thereto, as may be seen in FIG. 11, so that the carrier may be attached to hook 132 on the luggage. Moreover, the various panels of the described rigid baby carrier may be made conveniently foldable with respect to each other so that it can be folded in a substantially flat disposition for storage within the luggage when not in use.

On the other hand, a suitable flexible and foldable baby carrying device 139, as shown more particularly in FIG. 12, may embody the various panels decribed above for the rigid type but which are made from canvas or other suitable fabric material and may, optionally, include a suitable supporting relatively rigid seat frame 155 including a rod 157 or other suitable support at the top, or the like, to impart a degree of rigidity thereto when it is disposed in an open position for use. Device 139 is also provided with lead 134 and "D"-ring 136.

Returning to section 106, it is provided with integrally molded feet 76 and 78. The sloping walls are shaped so that they form sloping curved corners 138, 140, 142 and 146. Moreover, section 160 is provided on three sides of the sloping walls with an offset tongue 148 supported by a rib 150 and on the fourth side with one-half of butt hinge means 152.

Section 106 is also provided with a plurality of recesses 218 and 220 which are located in such a fashion that they will be directly opposite recesses 222 and 224 located on section 154 when the sections are mated. Recesses 218 and 220 have disposed therein the top halves of suitable locks, catches, or hasps 226 and 228, which mate with the bottom halves of suitable locks, catches, or hasps 230 and 232 which are disposed in recesses 222 and 224 of section 154, thus providing a means to lock the luggage when the sections are mated.

Consequently, up to this point the preferred variation of the instant invention illustrated in FIG. 2 parallels the constructon of the embodiment shown in FIG. 1 in essentially all details including optionally means for attaching additional pieces.

On the other hand, the second section 154 of the embodiment of FIG. 2 varies radically from section 12 of FIG. 1 in terms of its particular construction. While section 154 comprises a thin side panel 156 surrounded by four outwardly sloping walls 158, 160, 162 and 164 which have angled edges 166, 168, 170 and 172, as well as sloping curved corners 174, 176, 178, and 180, it is provided with shallow rib braces 182 and 184 which extend only partially across the surface of the thin side panel 156. In addition, side panel 156 of section 154 has disposed thereon a pair of sloping shallow parallel ribs 186 and 188 extending substantially completely across the extent thereof from wall 164 towards wall 160 which is provided with one-half of the butt hinge means 190. Butt hinge means 152 of section 106 and butt hinge means 190 are fitted with a suitable hinge pin 90, as shown in FIG. 4 which is preferably self-locking. Moreover, section 154 is molded that it has somewhat thickened portions 192 and 194 at each end of the channel 200 formed by the parallel ribs. In addition, section 154 is provided with an opening 196 through sloping wall 164. An extensible handle 198 is disposed in the channel 200 formed by the parallel ribs, the top portion of the handle extending through opening 196.

Figure 3:
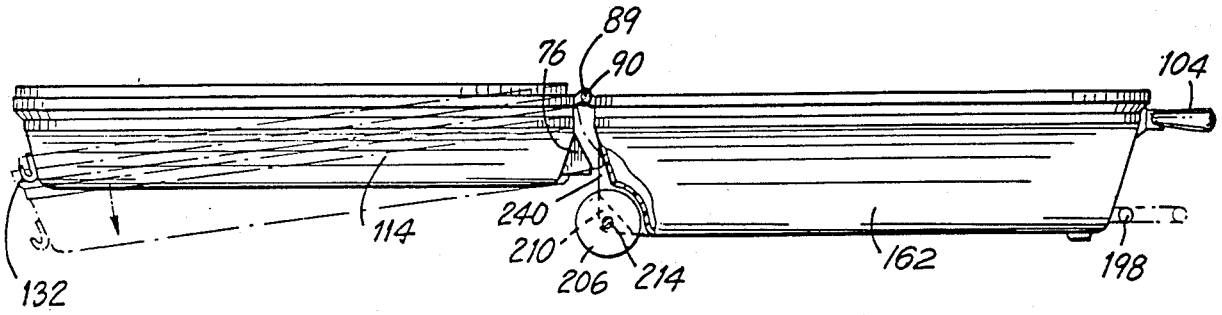
FIG. 3 is an end view of the luggage embodiment shown in FIG. 2 with the luggage disposed in an open position more than 180° and showing the integrally molded feet nesting in the recesses of the wheel wells and the extensible handle in partially extended condition in broken lines.
Figure 8:
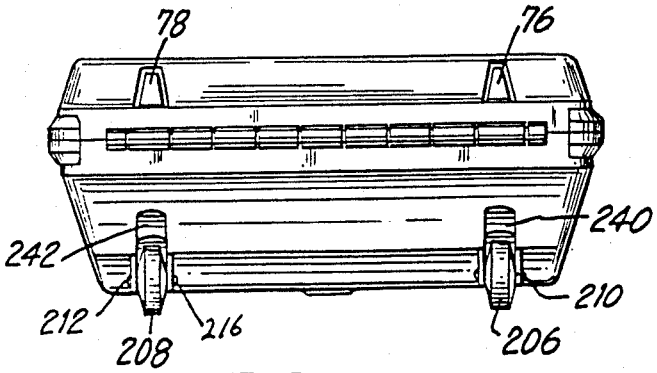
FIG. 8 is a bottom view of the luggage illustrated in FIG. 4.

Additionally, section 154 is provided with integrally molded, upwardly extending wheel cavities 202 and 204 located on wall 160 and side panel 156 which are housings for wheels 206 and 208 and recesses 240 and 242 for feet 76 and 78 in the opened position, as shown in FIGS. 3, 4, and 8. The wheel cavities contain flanges 210 and 212 which secure wheel axles such as 214 and 216. They also serve to provide additional strength to wall 160. The water proof wheel cavities and flanges can also be injection molded out of plastic, at the same time as the previously described components. If desired, the wheels can also be injection molded out of plastic.

An important feature of this invention is that recesses 240 and 242 are conveniently located so that upon opening the luggage, feet 76 and 78 will be disposed in the recesses, thus allowing the luggage to be opened at least 180° or more.

Figure 13:
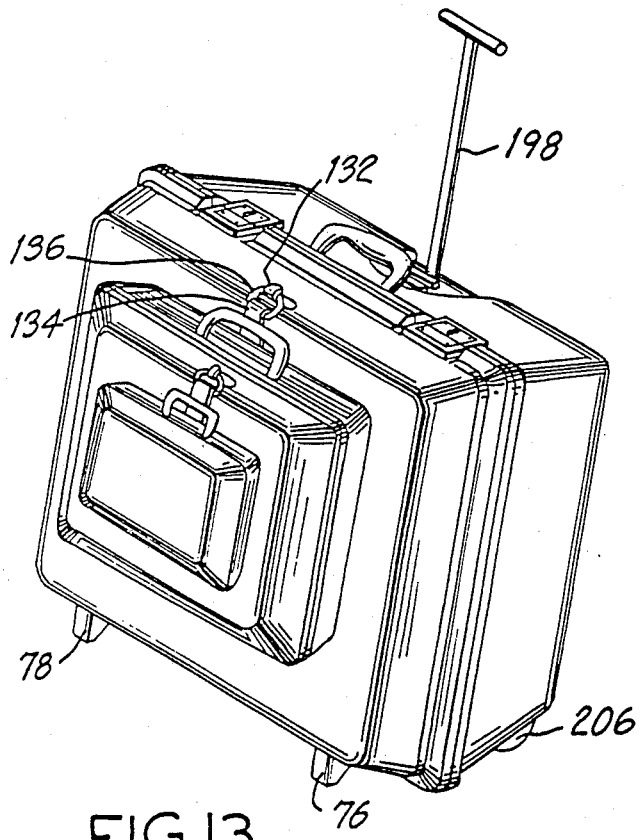
FIG. 13 is a view in perspective of a luggage in accordance with the invention showing a plurality of the luggage disposed in assembly.

Additionally it is possible for a section, such as section 12, of one luggage to have a lead 134, and a "D"-ring attachment as previously described, as well as an attaching means or hook 132 on the opposite side. In this way, more than one piece of luggage can be stacked or "piggybacked" as shown in FIG. 13.

Referring now to the embodiment of a luggage in accordance with the invention as shown in FIGS. 14 through 16, side panel 156, rather than being provided with channel 200, as illustrated in FIG. 2, is provided with an external molded, water proof groove 244 which is conveniently sized to receive the extensible handle 198. Moreover, while extensible handle 198 may be selected from a wide variety of available, suitable extensible handles, a preferred handle of this type is one having a hollow tubular member or housing tube 246 and a telescoping tubular shaft member 248 and including locking and unlocking means 302, as shown, for example in FIG. 7.

Groove 244 may be conveniently sized so that the housing tube 246 may be press fitted therein when the groove is molded in the side panel during manufacturing and while the plastic is still soft. Alternatively, the housing tube may be glued in the groove or inserted therein through a molded hole strenthened at the top and the tube may be riveted or fixed in any other convenient manner, to the side panel at the bottom of the groove. It is to be understood that the housing tube may also be riveted or fixed in any other convenient manner to the top of the groove also, if desired. It is to be understood further that any combination of the means mentioned for retaining or fixing the housing tube in the groove may be employed when making a luggage in accordance with this invention.

A luggage in accordance with this invention may be made in accordance with the following procedure.

A suitable plastic material, such as polyurethane, nylon, polyethylene, polyvinylchloride, or the like, either foamed or unfoamed, is disposed in suitably shaped molds and shaped in accordance with conventional plastic injection molding procedures to form mating sections such as sections 10 and 12 or 106 and 154, each section containing one-half of the butt hinge element and one section the tongue while the other section contains the mating groove, thus eliminating the need to separately manufacture and assemble the usual strengthening metal valances, the metal hinge and metal wheel cavities, as well as the feet, when they are employed, and the manufacturing and assembling time and costs they generally involve. In this respect, it is also to be understood that the wheels or casters may likewise be injection molded of plastic, thereby eliminating the need for separate manufacture thereof of metal. Moreover, the molding procedure can be carried out in a fast acting two part mold and the sections so formed will consist of accurately mating halves which, when assembled, form a substantially watertight luggage. If desired, the channel 200, mentioned above, in which the extensible handle is disposed may be molded in the form of a tunnel, or an opened tunnel, the opening thereof extending to the exterior of the side panel 156, this being accomplished by employing a suitable mold.

The sections so formed when molding is completed are then placed in a suitable jig or the like and all of the holes or openings for attaching the necessary hardware thereto are punched or drilled therein simultaneously.

Subsequently, the necessary hardware and wheels are riveted suitably attached in any other convenient manner to the respective sections as required, including insertion of the extensible handle where appropriate and also insertion of the self-locking hinge pin.

The interior of a luggage so formed may then be provided with appropriate padding and/or decorative textile material or other material such as leather and the like, and the exterior surfaces may be treated likewise with leather or polyvinylchloride covering or the like to achieve the desired aesthetic effects. In addition, a clothes partition curtain or curtains can be provided in the interior, or the interior can be subdivided into compartments, as desired. It is also to be understood that it is within the purview of this invention to employ plastics materials which may contain pigments or dyes in order to acheive a desired coloring effect. In such cases, of course, the external covering treatment may be dispensed with entirely, or may be employed to cover only selected areas of the exterior in order to achieve a desired aesthetic effect. It is also to be understood that the external and internal covering can be accomplished before drilling of the required openings or holes and attachment of the hardware. In this connection, however, the extensible handle, as a practical matter in facilitating the procedure, will generally be inserted and fixed in its channel or tunnel before any internal covering procedures are accomplished. Furthermore, it is to be understood that while conventional injection molded procedures are generally preferred in molding the above-described luggage sections, other conventional plastic molding procedures may be employed instead.

The present invention presents many advantages. For example, where the luggage is provided with an internally disposed telescoping extensible handle, it eliminates the need for a separate externally mounted, lightweight, wheeled luggage carrying frame which is a popular system currently in use. Moreover, the molded plastic wheeled luggage of this invention due to its unique construction permits "piggybacking" of portable baby carriers, and/or one or more additional pieces of molded luggage so that a user is not required to carry a number of separate pieces of luggage from one point to another, thus facilitating ease in travel as well as easy manipulation or transfer of a multiple number of pieces of luggage from one point to another. The advantages to a user of such luggage in terms of conservation of personal energy, relaxation and ease of movement while transporting the luggage are obvious.

Figure 7:
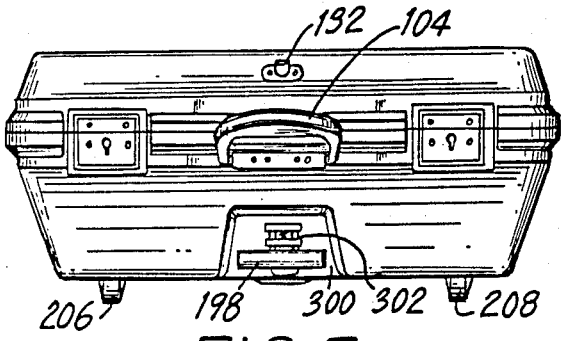
FIG. 7 is a plan view of the luggage illustrated in FIG. 4 in closed position and showing the recesses formed in the molded section in which the extensible handle and the hasps and locks are disposed, as well as the attaching means for attaching an additional object to the piece illustrated there to form an ensemble.

In addition to the above-mentioned advantages, luggage in accordance with this invention is particularly advantageous due to its unique, molded configuration. The lightweight, molded, rigid, plastic sections described above with their side panels, sloping walls having angled edges, sloping curved corners and plurality of shallow rib braces, the offset tongue and groove arrangement with their associated ribs or braces, the integrally molded butt hinge sections, the various thickened portions of the molded sections for anchoring the extensible handle at one end and supporting it at the other end, as well as for supporting the carrying handle or hand grip along with the various recesses for attaching the necessary external hardware, the wheel cavities and flanges and the recesses for the feet all interconnected in single molded platic shapes provide unique lightweight, exceptionally strong one-piece sections in which the constructional configuration imparts high strength to such sections, without the need for any metal valances or other metal supporting framework as generally employed in most known luggage. The shallowness of the various ribs, moreover, results in increased internal space and does not result in hindering the packing of large articles of clothing in the luggage, such as dresses, trousers, sport coats and the like. Furthermore, the luggage of this invention is relatively easy to manufacture by conventional injection molding techniques, or other conventional plastic molding processes with a wide variety of readily available plastics. Moreover, the necessary external hardware are likewise standard, readily commercially available elements which my be attached to the molded sections in a simple manner by conventional techniques. Still further, the various recesses for the external hardware, as well as the molded recess or depression 300 for the extensible handle, as shown in FIG. 7, act to protect these various elements from exposure to damage or the luggage being snagged on conveying means such as, for example, when the luggage is being transported on an airport conveyor system. Numerous other advantages of the luggage of this invention will be apparent to those skilled in the art.

It is to be understood that this invention in its broader aspects is not limited to the specific embodiments herein shown and described but departures may be made therefrom within the scope of the appended claims without departing from the principles of the invention and without sacrificing its chief advantages.

What is claimed is:

1. A process for making a light-weight, strong, molded, rigid plastic luggage comprising the steps of: molding foamed or unfoamed plastic and forming a first molded one-piece plastic section and a second molded one-piece plastic section adapted to cooperate with each other, each of said sections including a side panel, four integrally molded, sloping walls having sloping curved corners and angled edges projecting upwardly from and enclosing said side panel, integrally molded support means disposed on the side panel of at least one of said sections extending up said walls towards said angled edges substantially midway between the ends of said walls, integrally molded butt hinge means and a reinforcing rib disposed on the periphery of one of said walls and a plurality of shaped recesses for receiving the cooperating halves of locks or catches disposed on the wall directly opposite, the wall provided with the butt hinge means of at least one of said sections also being provided with at least two integrally molded feet located in the vicinity of the ends of and opposite said butt hinge means; three of the walls of said second section being provided with a pair of peripheral parallel ribs forming an offset groove extending continuously around and near the periphery thereof and three of the walls of said first section being provided with an offset tongue including a supporting rib which extends continuously around and near the periphery thereof, the butt hinge means on said first and second sections being positioned thereon so that they interleave with each other and form a continuous passageway for reception of a hinge pin, said offset tongue and said offset groove being positioned on the respective sections so that they mate and said shaped recesses being positioned on the respective sections so that they are located across from each other when said sections are assembled in cooperative relationship, placing said sections on a jig and forming openings therein for the reception of metallic hardware, attaching said hardware to said sections, disposing said sections in cooperative relationship and inserting said hinge pin in said passageway formed from the interleaving of the first and second butt hinge means.

2. A process according to claim 1 including encasing the molded one-piece plastic sections with a protective covering.

3. A process according to claim 2 including encasing the molded one-piece plastic sections with leather.

4. A process for making strong, light-weight, molded, rigid, luggage which comprises: molding foamed or unfoamed plastic and forming a first one-piece section and a second one-piece section adapted to cooperate with each other and to receive an extensible handle including a telescoping, tubular shaft member and locking and unlocking means; each of said sections including a side panel, four integrally molded, sloping walls having sloping curved corners and angled edges projecting upwardly from and enclosing said side panel, integrally molded support means disposed on the side panel of at least one of said sections extending up said side walls towards said angled edges substantially midway between the ends of said walls, integrally molded butt hinge means and a reinforcing rib disposed on the periphery of one of said walls and a plurality of shaped recesses for receiving the cooperative halves of locks or catches disposed on the wall directly opposite; the wall provided with the butt hinge means also being provided with at least two integrally molded feet located in the vicinity of the ends of and opposite said butt hinge means and the wall directly opposite having a strengthened portion for supporting fastening means; three of the walls of said second section being provided with a pair of peripheral parallel ribs forming an offset groove extending continuously around and near the periphery thereof, the remaining wall of said second section being provided with integrally molded base support means for attaching said extensible handle at one end and the wall directly opposite being provided with integrally molded support means including an opening therethrough for supporting the opposite end, a shaped recess for receiving the locking and unlocking means of said extensible handle located on the side panel of said second section and an attaching means supported on said integrally molded support means; three of the walls of said first section being provided with an offset tongue including a supporting rib which extends continuously around and near the periphery thereof; the side panel of said second section being provided on its integral surface with a centrally located pair of integral, spaced, shallow parallel ribs forming a groove extending across said side panel to the wall provided with the butt hinge means and the wall directly opposite, at least two integral, shallow rib braces disposed opposite each other at right angles to said groove and in contact with at least one of the surfaces of said side panel and the adjoining surfaces of two of the walls of said second section substantially midway between the corners thereof, at least two flanged wheel cavities including recesses located beyond the opposite ends of said butt hinge means; the butt hinge means on said first and second sections being positioned thereon so that they interleave with each other and form a continuous passageway for reception of a hinge pin, said offsest tongue and said offset groove being positioned on the respective sections so that they mate and said shaped recesses being positioned on the respective sections so that they are located across from each other when said sections are assembled in cooperative relationship; placing said sections on a jig and forming openings in said sections for the reception of metallic hardware, attaching said hardware to said sections, disposing said sections in cooperative relationship and inserting said hinge pin in said passageway formed from the interleaving of the first and second butt hinge means, disposing said extensible handle with the telescoping tubular shaft member in the groove formed by said integral, spaced, shallow, parallel, ribs, and disposing said locking and unlocking means for said handle in said shaped recess.

* * * * *